US009482173B2

(12) United States Patent
Buslepp et al.

(10) Patent No.: US 9,482,173 B2
(45) Date of Patent: Nov. 1, 2016

(54) FUEL CONTROL SYSTEMS AND METHODS FOR COLD STARTS

(71) Applicant: GM Global Technology Operations LLC, Detroit, MI (US)

(72) Inventors: Kenneth J. Buslepp, Brighton, MI (US); Julian R. Verdejo, Farmington, MI (US); Bruce F. Hunter, Okemos, MI (US); Daniel G. Brennan, Brighton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 222 days.

(21) Appl. No.: 14/457,391

(22) Filed: Aug. 12, 2014

(65) Prior Publication Data

US 2016/0047328 A1 Feb. 18, 2016

(51) Int. Cl.

| | |
|---|---|
| ***F02D 41/26*** | (2006.01) |
| ***F02D 41/30*** | (2006.01) |
| ***F02D 35/00*** | (2006.01) |
| ***F02D 41/00*** | (2006.01) |
| ***F02D 41/06*** | (2006.01) |
| ***F02D 35/02*** | (2006.01) |
| *F02D 41/14* | (2006.01) |

(52) U.S. Cl.

CPC ..... *F02D 41/26* (2013.01); *F02D 35/0046* (2013.01); *F02D 35/0092* (2013.01); *F02D 35/023* (2013.01); *F02D 41/0085* (2013.01); *F02D 41/064* (2013.01); *F02D 41/30* (2013.01); *F02D 41/009* (2013.01); *F02D 41/0097* (2013.01); *F02D 41/1441* (2013.01); *F02D 2041/1417* (2013.01); *F02D 2200/0611* (2013.01)

(58) Field of Classification Search

CPC .... F02D 41/0085; F02D 41/26; F02D 41/30; F02D 35/0046; F02D 35/0092

USPC ..... 701/103, 104, 102; 123/478, 480, 435, 123/673

See application file for complete search history.

(56) References Cited

U.S. PATENT DOCUMENTS

2011/0087418 A1* 4/2011 Wang ..... F02D 13/0219 701/101

* cited by examiner

*Primary Examiner* — Mahmoud Gimie

(57) ABSTRACT

An indicated mean effective pressure (IMEP) module determines IMEPs for combustion cycles of cylinders of an engine, respectively. A coldstart indication module indicates whether the engine is in a cold state after a startup of the engine. A fueling correction module, when the engine is in the cold state, selectively increases a fueling correction for one of the cylinders based on the IMEP of the one of the cylinders. An equivalence ratio (EQR) module selectively increases an EQR of the one of the cylinders based on the fueling correction for the one of the cylinders.

20 Claims, 7 Drawing Sheets

FUEL CONTROL SYSTEMS AND METHODS FOR COLD STARTS

FIELD

The present disclosure relates to internal combustion engines and more particularly to fuel control systems and methods for vehicles.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A fuel control system controls provision of fuel to an engine. The fuel control system includes an inner control loop and an outer control loop. The inner control loop may use data from an exhaust gas oxygen (EGO) sensor located upstream from a catalyst in an exhaust system. The catalyst receives exhaust gas output by the engine.

The inner control loop selectively adjusts the amount of fuel provided to the engine based on the data from the upstream EGO sensor. For example only, when the upstream EGO sensor indicates that the exhaust gas is (fuel) rich, the inner control loop may decrease the amount of fuel provided to the engine. Conversely, the inner control loop may increase the amount of fuel provided to the engine when the exhaust gas is lean. Adjusting the amount of fuel provided to the engine based on the data from the upstream EGO sensor modulates the air/fuel mixture combusted within the engine at approximately a desired air/fuel mixture (e.g., a stoichiometry mixture).

The outer control loop selectively adjusts the amount of fuel provided to the engine based on data from an EGO sensor located downstream from the catalyst. For example only, the outer control loop may use the data from the upstream and downstream EGO sensors to determine an amount of oxygen stored by the catalyst and other suitable parameters. The outer control loop may also use the data from the downstream EGO sensor to correct the data provided by the upstream and/or downstream EGO sensors when the downstream EGO sensor provides unexpected data.

SUMMARY

In a feature, a fuel control system for a vehicle is disclosed. An indicated mean effective pressure (IMEP) module determines IMEPs for combustion cycles of cylinders of an engine, respectively. A coldstart indication module indicates whether the engine is in a cold state after a startup of the engine. A fueling correction module, when the engine is in the cold state, selectively increases a fueling correction for one of the cylinders based on the IMEP of the one of the cylinders. An equivalence ratio (EQR) module selectively increases an EQR of the one of the cylinders based on the fueling correction for the one of the cylinders.

In further features, an averaging module averages the IMEPs for combustion cycles of at least two of the cylinders, respectively, to produce an average IMEP. The fueling correction module selectively increases the fueling correction for the one of the cylinders based on a difference between the IMEP of the one of the cylinders and the average IMEP.

In further features, the fueling correction module increases the fueling correction for the one of the cylinders when the IMEP of the one of the cylinders is less than the average IMEP.

In further features, when the IMEP of the one of the cylinders is within a predetermined amount of the average IMEP: the fueling correction module sets the fueling correction for the one of the cylinders to a predetermined value; and the EQR module does not increase the EQR of the one of the cylinders when the fueling correction is set to the predetermined value.

In further features, the fueling correction module limits the increase in the fueling correction for the one of the cylinders to a maximum increase value.

In further features, a maximum module determines the maximum increase value based on an intake valve temperature.

In further features, the maximum module: increases the maximum increase value as the intake valve temperature decreases; and decreases the maximum increase value as the intake valve temperature increases.

In further features, the coldstart indication module indicates that the engine is in the cold state after the startup of the engine when the intake valve temperature is less than a predetermined temperature.

In further features, when the engine is not in the cold state after the engine startup: the fueling correction module sets the fueling correction for the one of the cylinders to a predetermined value; and the EQR module does not increase the EQR of the one of the cylinders when the fueling correction is set to the predetermined value.

In further features, after increasing the fueling correction of the one of the cylinders based on the IMEP of the one of the cylinders, the fueling correction module selectively decreases the fueling correction of the one of the cylinders at a predetermined rate.

In a feature, a fuel control method for a vehicle is disclosed. The fuel control method includes: determining indicated mean effective pressures (IMEPs) for combustion cycles of cylinders of an engine, respectively; indicating whether the engine is in a cold state after a startup of the engine; when the engine is in the cold state, selectively increasing a fueling correction for one of the cylinders based on the IMEP of the one of the cylinders; and selectively increasing an equivalence ratio (EQR) of the one of the cylinders based on the fueling correction for the one of the cylinders.

In further features, the fuel control method further includes: averaging the IMEPs for combustion cycles of at least two of the cylinders, respectively, to produce an average IMEP; and selectively increasing the fueling correction for the one of the cylinders based on a difference between the IMEP of the one of the cylinders and the average IMEP.

In further features, the fuel control method further includes increasing the fueling correction for the one of the cylinders when the IMEP of the one of the cylinders is less than the average IMEP.

In further features, the fuel control method further includes, when the IMEP of the one of the cylinders is within a predetermined amount of the average IMEP: setting the fueling correction for the one of the cylinders to a predetermined value; and not increasing the EQR of the one of the cylinders when the fueling correction is set to the predetermined value.

In further features, the fuel control method further includes limiting the increase in the fueling correction for the one of the cylinders to a maximum increase value.

In further features, the fuel control method further includes determining the maximum increase value based on an intake valve temperature.

In further features, the fuel control method further includes: increasing the maximum increase value as the intake valve temperature decreases; and decreasing the maximum increase value as the intake valve temperature increases.

In further features, the fuel control method further includes indicating that the engine is in the cold state after the startup of the engine when the intake valve temperature is less than a predetermined temperature.

In further features, the fuel control method further includes, when the engine is not in the cold state after the engine startup: setting the fueling correction for the one of the cylinders to a predetermined value; and not increasing the EQR of the one of the cylinders when the fueling correction is set to the predetermined value.

In further features, the fuel control method further includes, after increasing the fueling correction of the one of the cylinders based on the IMEP of the one of the cylinders, selectively decreasing the fueling correction of the one of the cylinders at a predetermined rate.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An engine combusts a mixture of air and fuel within cylinders to produce torque. An engine control module (ECM) controls fuel injection for the cylinders. When the engine is cold when started, injected fuel may be unable to vaporize within one or more cylinders as expected. A cylinder having a low indicated mean effective pressure (IMEP) may indicate that fuel provided to that cylinder was unable to vaporize as expected. Fuel may be unable to vaporize as expected, for example, due to the fuel's ethanol content, variation in the fuel's volatility due to seasonal fueling grade, and/or other sources of fuel volatility variation.

The ECM of the present disclosure selectively richens fueling of cylinders based on the cylinders' IMEPs, respectively. For example, the ECM may richen fueling of a cylinder when the cylinder's IMEP is less than an average IMEP. Richening the fueling of cylinders having low IMEPs may help balance an output (e.g., torque) of those cylinders with the outputs of other cylinders.

Figure 1:
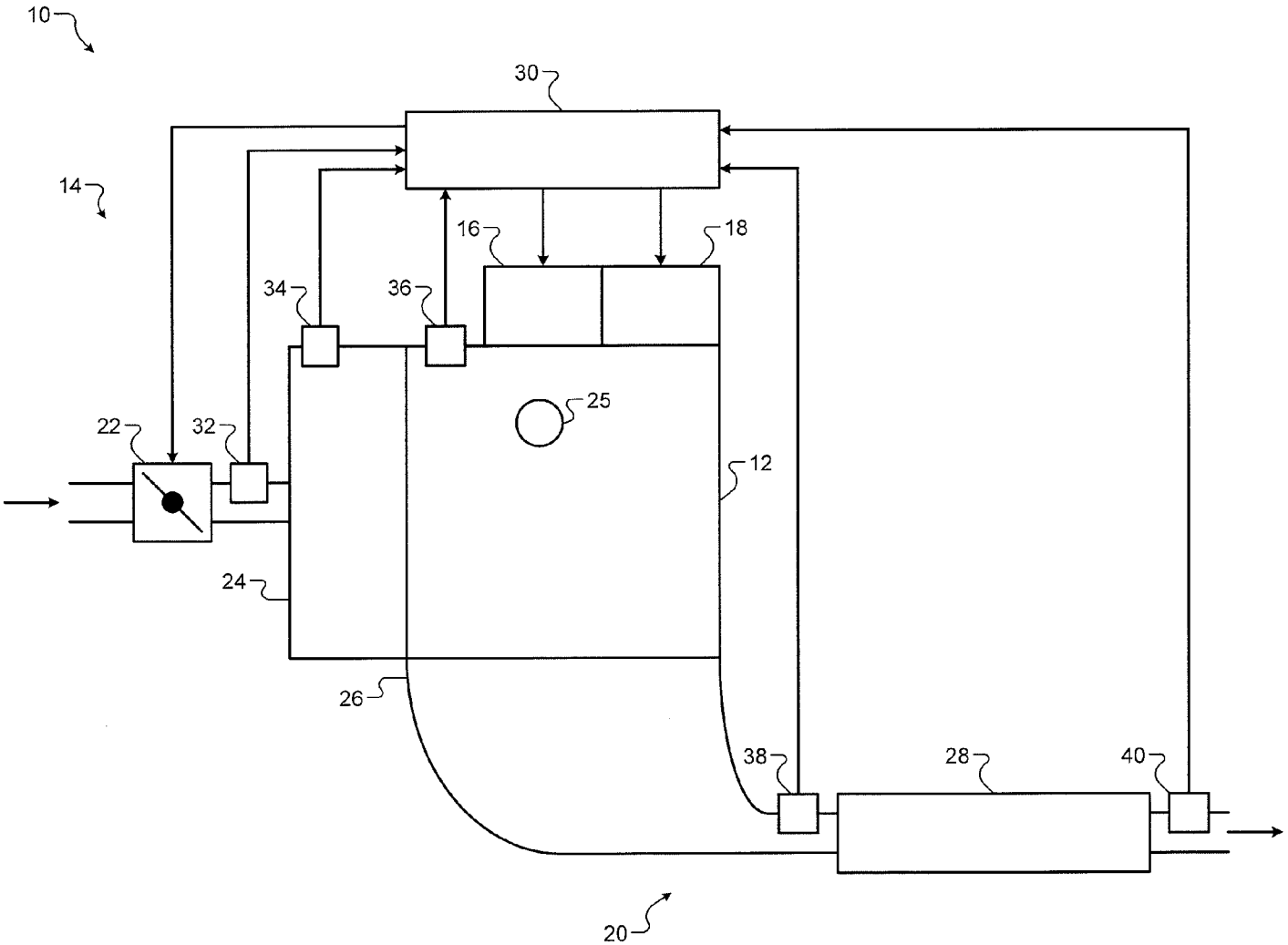
FIG. 1 is a functional block diagram of an example engine system.

Referring now to FIG. 1, a functional block diagram of an example engine system 10 is presented. The engine system 10 includes an engine 12, an intake system 14, a fuel injection system 16, an ignition system 18, and an exhaust system 20. While the engine system 10 is shown and will be described in terms of a gasoline engine, the present application is applicable to diesel engine systems, hybrid engine systems, and other suitable types of engine systems.

The intake system 14 may include a throttle 22 and an intake manifold 24. The throttle 22 controls air flow into the intake manifold 24. Air flows from the intake manifold 24 into one or more cylinders within the engine 12, such as cylinder 25. While only the cylinder 25 is shown, the engine 12 may include more than one cylinder. The fuel injection system 16 includes a plurality of fuel injectors and controls fuel injection for the engine 12.

Exhaust resulting from combustion of the air/fuel mixture is expelled from the engine 12 to the exhaust system 20. The exhaust system 20 includes an exhaust manifold 26 and a catalyst 28. For example only, the catalyst 28 may include a three way catalyst (TWC) and/or another suitable type of catalyst. The catalyst 28 receives the exhaust output by the engine 12 and reacts with various components of the exhaust.

The engine system 10 also includes an engine control module (ECM) 30 that regulates operation of the engine system 10. The ECM 30 communicates with the intake system 14, the fuel injection system 16, and the ignition system 18. The ECM 30 also communicates with various sensors. For example only, the ECM 30 may communicate with a mass air flow (MAF) sensor 32, a manifold air pressure (MAP) sensor 34, a crankshaft position sensor 36, and other suitable sensors.

The MAF sensor 32 measures a mass flow rate of air flowing into the intake manifold 24 and generates a MAF signal based on the mass flow rate. The MAP sensor 34 measures pressure within the intake manifold 24 and generates a MAP signal based on the pressure. In some implementations, vacuum within the intake manifold 24 may be measured relative to ambient pressure.

The crankshaft position sensor 36 monitors rotation an N-toothed wheel (not shown) and generates a crankshaft position signal based on rotation of the N-toothed wheel. For example only, the crankshaft position sensor 36 may include a variable reluctance (VR) sensor or another suitable type of crankshaft position sensor. The N-toothed wheel rotates with the crankshaft of the engine 12. The N-toothed wheel includes space for N equally spaced teeth.

The crankshaft position sensor 36 generates a pulse in the crankshaft position signal each time when a tooth of the N-toothed wheel (e.g., rising or falling edge of the tooth) passes the crankshaft position sensor 36. Accordingly, each pulse in the crankshaft position signal may correspond to an angular rotation of the crankshaft by an amount equal to 360° divided by N. For example only, the N-toothed wheel may include space for 60 equally spaced teeth (i.e., N=60), and each pulse in the crankshaft position signal may therefore correspond to approximately 6° of crankshaft rotation. In various implementations, one or more of the N teeth may be omitted. For example only, two of the N teeth may be omitted in various implementations.

While the rotational distance between consecutive teeth of the N-toothed wheel should be equal (e.g., 6° in the above example), the rotational distances between consecutive teeth may vary. The variation may be due to, for example, manufacturing tolerances, part-to-part variation, wear, sensor variation, and/or one or more other sources.

The ECM 30 selectively learns the distance between each pair of consecutive teeth of the N-toothed wheel. Based on the learned distances and the crankshaft position signal, the ECM 30 generates a second crankshaft position signal. The second crankshaft position signal may also be used for cylinder identification, to determine an engine speed as discussed further below, and for other uses. The engine speed signal at a given crankshaft position indicates the instantaneous engine speed at the crankshaft position.

The ECM 30 also communicates with exhaust gas oxygen (EGO) sensors associated with the exhaust system 20. For example only, the ECM 30 communicates with an upstream EGO sensor (US EGO sensor) 38 and a downstream EGO sensor (DS EGO sensor) 40. The US EGO sensor 38 is located upstream of the catalyst 28, and the DS EGO sensor 40 is located downstream of the catalyst 28. The US EGO sensor 38 may be located, for example, at a confluence point of exhaust runners (not shown) of the exhaust manifold 26 or at another suitable location.

The US and DS EGO sensors 38 and 40 measure amounts of oxygen in the exhaust at their respective locations and generate EGO signals based on the amounts of oxygen. For example only, the US EGO sensor 38 generates an upstream EGO (US EGO) signal based on the amount of oxygen upstream of the catalyst 28. The DS EGO sensor 40 generates a downstream EGO (DS EGO) signal based on the amount of oxygen downstream of the catalyst 28.

The US and DS EGO sensors 38 and 40 may each include a switching EGO sensor, a universal EGO (UEGO) sensor (also referred to as a wide band or wide range EGO sensor), or another suitable type of EGO sensor. A switching EGO sensor generates an EGO signal in units of voltage. The generated EGO signal is between a low voltage (e.g., approximately 0.1 V) and a high voltage (e.g., approximately 0.8 V) when the oxygen concentration is lean and rich, respectively. A UEGO sensor generates an EGO signal that corresponds to an equivalence ratio (EQR) of the exhaust gas and provides measurements between rich and lean.

Figure 2:
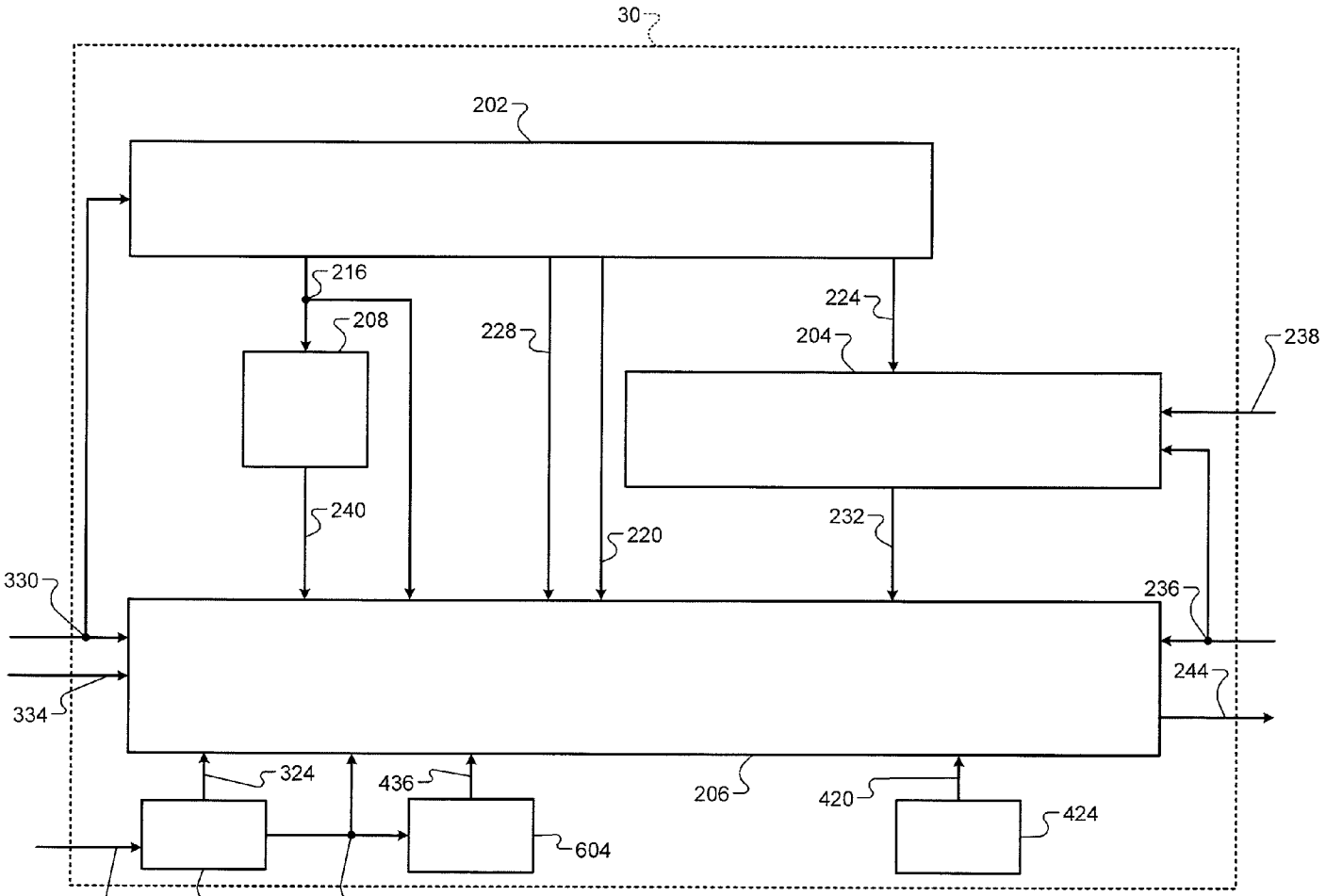
FIG. 2 is a functional block diagram of an example engine control module.

Referring now to FIG. 2, a functional block diagram of a portion of an example implementation of the ECM 30 is presented. The ECM 30 may include a base equivalence ratio (EQR) module 202, an outer loop module 204, an inner loop module 206, and a reference generation module 208.

The base EQR module 202 may determine one or more engine operating conditions. For example only, the engine operating conditions may include, but are not limited to, air per cylinder (APC), engine load 216, and/or other suitable parameters. The APC may be predicted for one or more future combustion events in some engine systems. The engine load 216 may be determined based on, for example, a ratio of the APC to a maximum APC of the engine 12. The engine load 216 may alternatively be determined based on an indicated mean effective pressure (IMEP), engine torque, or another suitable parameter indicative of engine load.

The base EQR module 202 generates a base EQR request 220. The base EQR request 220 may be generated, for example, based on an APC and to achieve a target equivalence ratio (EQR) of the air/fuel mixture. For example only, the target EQR may include a stoichiometric EQR (i.e., 1.0). An EQR may refer to a ratio of an air/fuel mixture to a stoichiometric air/fuel mixture. The base EQR module 202 also determines a target downstream exhaust gas output (a target DS EGO) 224. The base EQR module 202 may determine the target DS EGO 224 based on, for example, one or more engine operating conditions.

The base EQR module 202 may also generate one or more open-loop fueling corrections 228 for the base EQR request 220. The open-loop fueling corrections 228 may include, for example, a sensor correction and an error correction. For example only, the sensor correction may correspond to a correction to the base EQR request 220 to accommodate the measurements of the US EGO sensor 38. The error correction may correspond to a correction in the base EQR request 220 to account for errors that may occur, such as errors in the determination of the APC and errors attributable to fuel vapor purging.

The outer loop module 204 also generates one or more open-loop fueling corrections for the base EQR request 220, such as downstream correction (DS correction) 232. The outer loop module 204 may generate, for example, an oxygen storage correction and an oxygen storage maintenance correction. For example only, the oxygen storage correction may correspond to a correction in the base EQR request 220 to adjust the oxygen storage of the catalyst 28 to a target oxygen storage within a predetermined period. The oxygen storage maintenance correction may correspond to a correction in the base EQR request 220 to modulate the oxygen storage of the catalyst 28 at approximately the target oxygen storage.

The outer loop module 204 may estimate the oxygen storage of the catalyst 28 based on a US EGO signal 236 (generated by the US EGO sensor 38) and a DS EGO signal 238 (generated by the DS EGO sensor 40). The outer loop module 204 may generate the open-loop fueling corrections to adjust the oxygen storage of the catalyst 28 to the target oxygen storage and/or to maintain the oxygen storage at approximately the target oxygen storage. The outer loop module 204 generates the DS correction 232 to minimize a difference between the DS EGO signal 238 and the target DS EGO 224.

The inner loop module 206 (see also FIG. 3) determines an upstream EGO error based on a difference between the US EGO signal 236 and an expected US EGO. The US EGO error may correspond to, for example, a correction in the base EQR request 220 to minimize the difference between the US EGO signal 236 and the expected US EGO. The inner loop module 206 normalizes the US EGO error to produce a normalized error and selectively adjusts the base EQR request 220 based on the normalized error.

The inner loop module 206 also determines an imbalance (fueling) correction for the cylinder 25. The inner loop module 206 determines an imbalance correction for each of the cylinders. The imbalance corrections may also be referred to as individual cylinder fuel correction (ICFCs) or fueling corrections. The imbalance correction for a cylinder may correspond to, for example, a correction in the base EQR request 220 to balance an output of the cylinder with output of the other cylinders.

The inner loop module 206 also determines coldstart (fueling) corrections for the cylinders, respectively. When the engine 12 is cold at startup, fuel may be unable to vaporize to the extent expected for a period after the startup. Different types and blends of fuel may also have different vaporization characteristics and therefore may vaporize differently.

Despite being provided with an amount of fuel corresponding to a requested EQR, a cylinder where fuel vaporizes to a lesser extent may appear to have received lean fueling and may output less torque than other cylinders. Fuel may vaporize to a lesser extent, for example, when the engine 12 is cold. The coldstart correction for a cylinder may correspond to a correction in the base EQR request 220 to balance an output of the cylinder with output of other cylinders when a coldstart of the engine 12 is performed.

The reference generation module 208 generates a reference signal 240. For example only, the reference signal 240 may include a sinusoidal wave, triangular wave, or another suitable type of periodic signal. The reference generation module 208 may selectively vary the amplitude and frequency of the reference signal 240. For example only, the reference generation module 208 may increase the frequency and amplitude as the engine load 216 increases and vice versa. The reference signal 240 may be provided to the inner loop module 206 and one or more other modules.

The reference signal 240 may be used in determining a final EQR request 244 to toggle the EQR of the exhaust gas provided to the catalyst 28 back and forth between a predetermined rich EQR and a predetermined lean EQR. For example only, the predetermined rich EQR may be approximately 3 percent rich (e.g., an EQR of 1.03), and the predetermined lean EQR may be approximately 3 percent lean (e.g., an EQR of approximately 0.97). Toggling the EQR may improve the efficiency of the catalyst 28. Additionally, toggling the EQR may be useful in diagnosing faults in the US EGO sensor 38, the catalyst 28, the DS EGO sensor 40, and/or one or more other components.

The inner loop module 206 determines the final EQR request 244 based on the base EQR request 220 and the normalized error. The inner loop module 206 determines the final EQR request 244 further based on the sensor correction, the error correction, the oxygen storage correction, and the oxygen storage maintenance correction, the reference signal 240, the imbalance correction for the cylinder 25, and the coldstart correction for the cylinder 25. The ECM 30 controls the fuel injection system 16 based on the final EQR request 244. For example only, the ECM 30 may control the fuel injection system 16 using pulse width modulation (PWM).

Figure 3:
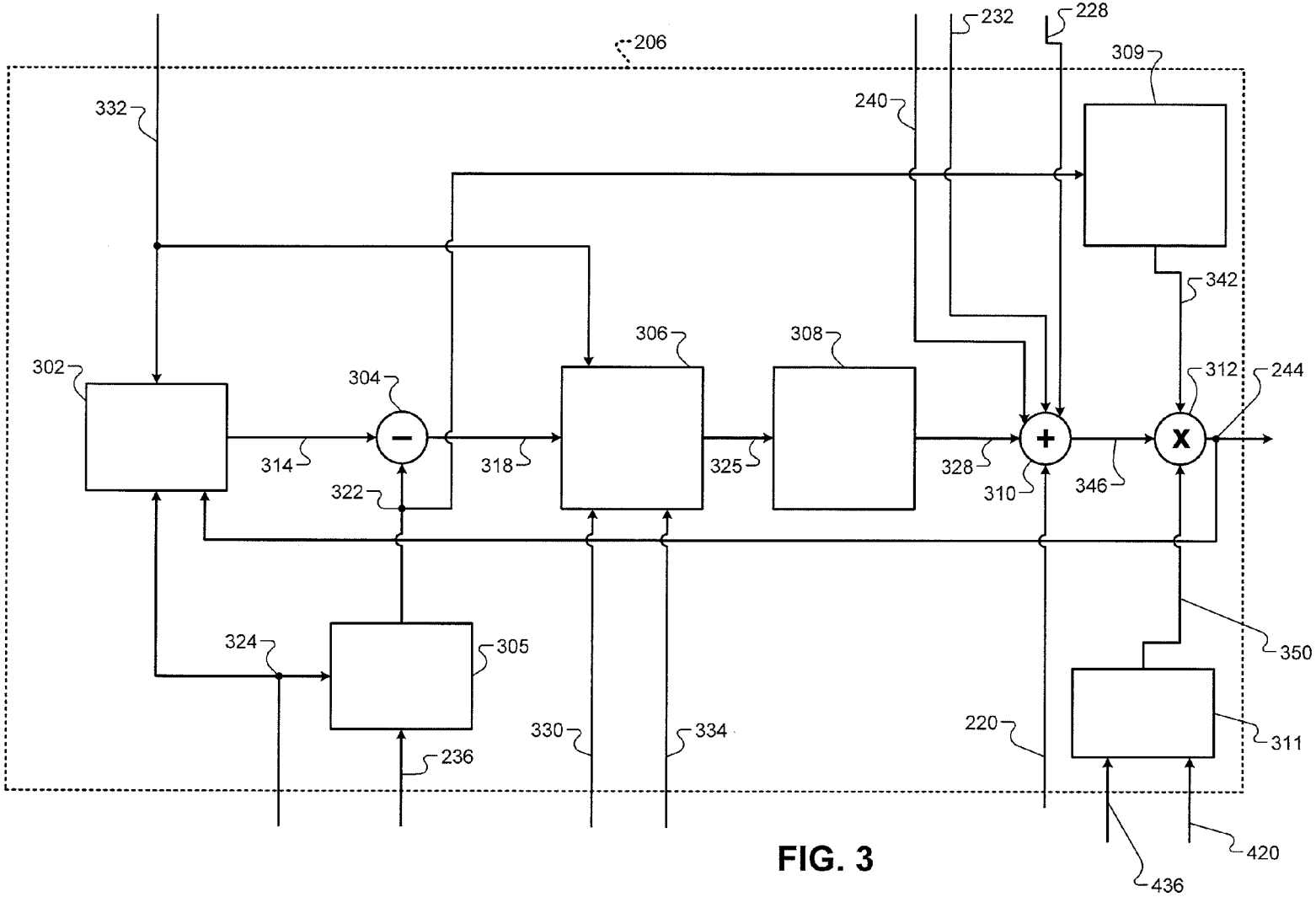
FIG. 3 is a functional block diagram of an example inner loop module.

Referring now to FIG. 3, a functional block diagram of an example implementation of the inner loop module 206 is presented. The inner loop module 206 may include an expected US EGO module 302, an error module 304, a sampling module 305, a scaling module 306, and a normalization module 308. The inner loop module 206 may also include an imbalance correction module 309, an initial EQR module 310, a coldstart correction module 311, and a final EQR module 312.

The expected US EGO module 302 determines an expected US EGO 314. In implementations where the US EGO sensor 38 is a WRAF sensor or a UEGO sensor, the expected US EGO module 302 determines the expected US EGO 314 based on the final EQR request 244. The expected US EGO 314 corresponds to an expected value of a given sample of the US EGO signal 236. However, delays of the engine system 10 prevent the exhaust gas resulting from combustion from being immediately reflected in the US EGO signal 236. The delays of the engine system 10 may include, for example, an engine delay, a transport delay, and a sensor delay.

The engine delay may correspond to a period between, for example, when fuel is provided to a cylinder of the engine 12 and when the resulting exhaust is expelled from the cylinder. The transport delay may correspond to a period between when the resulting exhaust is expelled from the cylinder and when the resulting exhaust reaches the location of the US EGO sensor 38. The sensor delay may correspond to the delay between when the resulting exhaust reaches the location of the US EGO sensor 38 and when the resulting exhaust is reflected in the US EGO signal 236.

The US EGO signal 236 may also reflect a mixture of the exhaust produced by different cylinders of the engine 12. The expected US EGO module 302 accounts for exhaust mixing and the engine, transport, and sensor delays in determining the expected US EGO 314. The expected US EGO module 302 stores the EQR of the final EQR request 244. The expected US EGO module 302 determines the expected US EGO 314 based on one or more stored EQRs, exhaust mixing, and the engine, transport, and sensor delays.

The error module 304 determines an upstream EGO error (US EGO error) 318 based on a sample of the US EGO signal (a US EGO sample) 322 taken at a given sampling time and the expected US EGO 314 for the given sampling time. More specifically, the error module 304 determines the US EGO error 318 based on a difference between the US EGO sample 322 and the expected US EGO 314.

The sampling module 305 selectively samples the US EGO signal 236 and provides the samples to the error module 304. The sampling module 305 may sample the US EGO signal 236 at a predetermined rate, such as once per predetermined number of crankshaft angle degrees (CAD) as indicated by a crankshaft position 324 measured using the crankshaft position sensor 36. The crankshaft position 324 is determined by a filter module 326 (see FIGS. 2 and 5) based on a crankshaft position signal 327 generated by the crankshaft position sensor 36, as discussed further below. The predetermined rate may be set, for example, based on the number of cylinders of the engine 12, the number of EGO sensors implemented, the firing order of the cylinders, and a configuration of the engine 12. For example only, for a four cylinder engine with one cylinder bank and one EGO sensor, the predetermined rate may be approximately eight CAD based samples per engine cycle or another suitable rate.

The scaling module 306 determines a scaled error 325 based on the US EGO error 318. The scaling module 306 may apply one or more gains or other suitable control factors in determining the scaled error 325 based on the US EGO error 318. For example only, the scaling module 306 may determine the scaled error 325 using the equation:

$$\text{Scaled Error} = \frac{MAF}{14.7} * US\ EGO\ \text{Error}, \tag{1}$$

where Scaled Error is the scaled error 325, MAF is a MAF 330 measured using the MAF sensor 32, and US EGO Error is the US EGO error 318. In various implementations, the scaling module 306 may determine the scaled error 325 using the relationship:

$$\text{Scaled Error} = k(\text{MAP},\text{RPM}) * \text{US EGO Error}, \tag{2}$$

where RPM is an engine speed 332, MAP is a MAP 334 measured using the MAP sensor 34, k is a function of the MAP 334 and the engine speed 332, and US EGO Error is the US EGO error 318. In some implementations, k may be additionally or alternatively be a function of the engine load 216. The engine speed 332 is determined by the filter module 326 (see FIGS. 2 and 5) based on the crankshaft position 324, as discussed further below.

The normalization module 308 determines a normalized error 328 based on the scaled error 325. For example only, the normalization module 308 may include a proportional-integral (PI) controller, a proportional (P) controller, an integral (I) controller, or a proportional-integral-derivative (PID) controller that determines the normalized error 328 based on the scaled error 325.

The imbalance correction module 309 monitors the US EGO samples 322 of the US EGO signal 236. The imbalance correction module 309 determines imbalance values for the cylinders of the engine 12 based on the (present) US EGO sample 322 and an average of a predetermined number of previous US EGO samples 322.

The imbalance correction module 309 determines an offset value that relates (associates) one of the imbalance values to (with) one of the cylinders of the engine 12. The imbalance correction module 309 correlates the other cylinders of the engine with the other imbalance values, respectively, based on the firing order of the cylinders. The imbalance correction module 309 determines imbalance (fueling) corrections for the cylinders of the engine 12 based on the imbalance values associated with the cylinders, respectively. For example, the imbalance correction module 309 may determine an imbalance correction 342 for the cylinder 25 based on the imbalance value associated with the cylinder 25.

The initial EQR module 310 determines an initial EQR request 346 based on the base EQR request 220, the reference signal 240, the normalized error 328, the open-loop fueling correction(s) 228, and the DS correction 232. For example only, the initial EQR module 310 may determine the initial EQR request 346 based on the sum of the base EQR request 220, the reference signal 240, the normalized error 328, the open-loop fueling correction(s) 228, and the DS correction 232.

The final EQR module 312 determines the final EQR request 244 based on the initial EQR request 346 and the imbalance correction 342. The final EQR module 312 determines the final EQR request 244 further based on a coldstart correction 350. More specifically, the final EQR module 312 selectively corrects the initial EQR request 346 based on the imbalance correction 342 is associated with the next cylinder in the firing order and the coldstart correction 350 that is associated with the next cylinder in the firing order. The final EQR module 312 may, for example, set the final EQR request 244 equal to a product of the initial EQR request 346, the imbalance correction 342, and the coldstart correction 350. The final EQR module 312 controls fuel injection for the next cylinder in the firing order based on the final EQR request 244.

Figure 4:
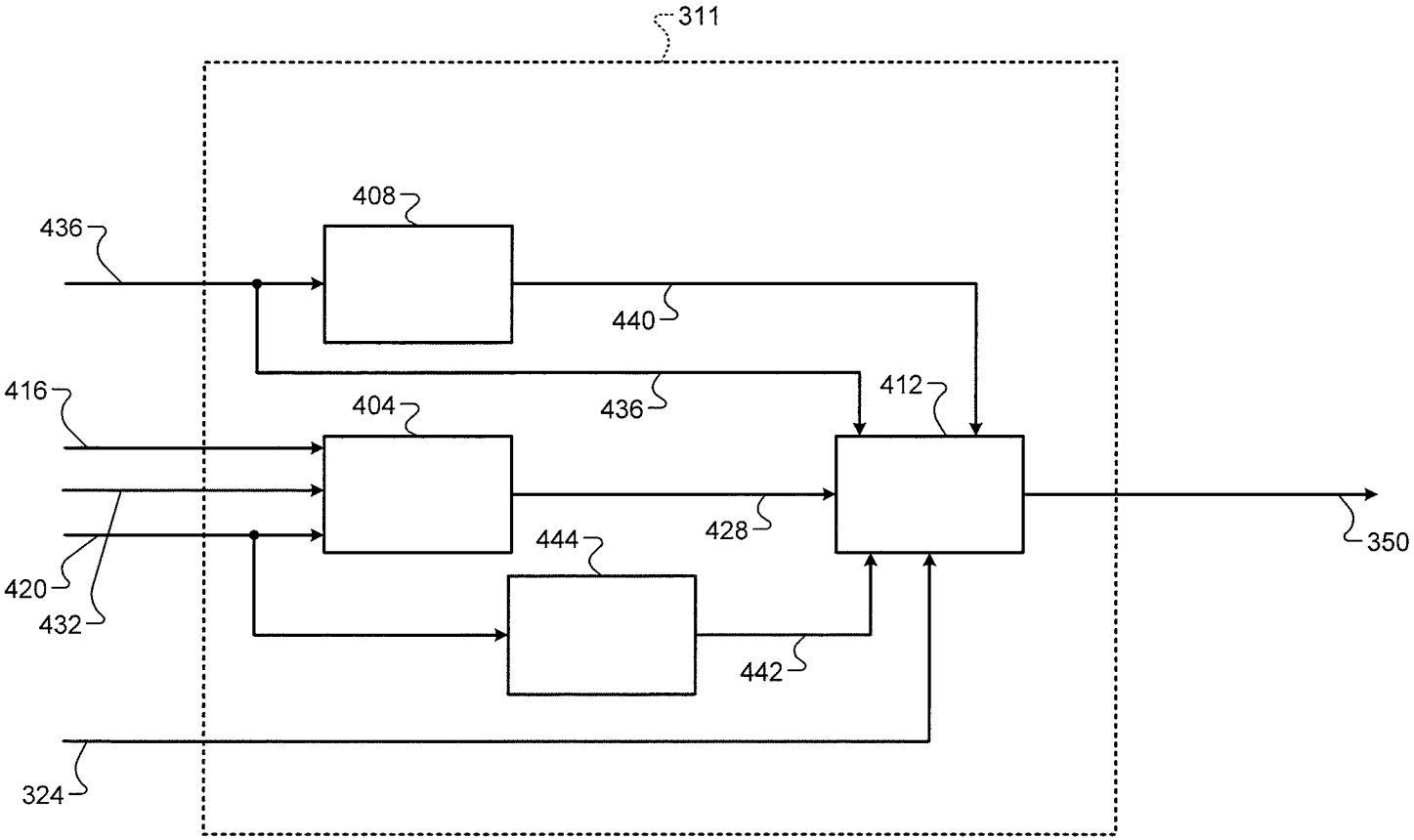
FIG. 4 is a functional block diagram of an example coldstart correction module.

The coldstart correction module 311 determines the coldstart corrections 350 for the cylinders, respectively. FIG. 4 is a functional block diagram of an example implementation of the coldstart correction module 311. Referring now to FIG. 4, the coldstart correction module 311 may include a coldstart indication module 404, an averaging module 408, and a fueling correction module 412.

When the engine 12 is started in response to user input, the coldstart indication module 404 determines whether fueling of the engine 12 should be controlled for a coldstart. In other words, the coldstart indication module 404 determines whether the engine 12 is in a cold state. A user may start the engine 12, for example, via an ignition key, button, or switch. User input to start the engine 12 may be indicated, for example, via an ignition signal 416.

The coldstart indication module 404 determines whether fueling of the engine 12 should be controlled for a coldstart, for example, based on an intake valve temperature (IVT) 420. For example, the coldstart indication module 404 may determine that fueling of the engine 12 should be controlled for a coldstart when the IVT 420 is less than a predetermined temperature at engine startup and determine that fueling of the engine 12 should not be controlled for a coldstart when the IVT 420 is greater than the predetermined temperature at engine startup. The IVT 420 corresponds to an estimated temperature of one or more intake valves of the engine 12.

Referring back to FIG. 2, an IVT module 424 determines the IVT 420. When the engine 12 is started, the IVT module 424 may determine the IVT 420 based on the IVT 420 at the time when the engine 12 was last shut down, an engine off period, and an engine coolant temperature (ECT). The ECT may be, for example, measured using an ECT sensor. The engine off period corresponds to a period between when the engine 12 was last shutdown and when the engine 12 was next started. The IVT module 424 may determine the IVT 420 at the startup of the engine 12, for example, using a function or a mapping that relates the IVT 420 when the engine 12 was last shut down, the engine off period, and the ECT to values of the IVT 420 at engine startup.

As the engine 12 runs after engine startup, the IVT module 424 may determine the IVT 420 based on the engine speed 332, the MAP 334, the ECT, a spark timing used, an EQR of fuel supplied to the engine 12, and an amount (e.g., a percentage) of ethanol in the fuel supplied to the engine 12. The IVT module 424 may determine the IVT 420 using one or more functions or mappings that relate the engine speed 332, the MAP 334, the ECT, the spark timing, the EQR of fuel supplied to the engine 12, and the amount of ethanol in the fuel supplied to the engine 12 to IVT values.

The IVT module 424 may also apply a filter to the IVT values to determine the IVT 420. For example, the IVT module 424 may apply a low-pass filter to the IVT values determined based on the engine speed 332, the MAP 334, the ECT, the spark timing, the EQR of fuel supplied to the engine 12, and the amount of ethanol in the fuel supplied to the engine 12. The IVT module 424 may determine a filter coefficient of the filter, for example, based on the MAF 330 using a function or mapping that relates the MAF 330 to the filter coefficient.

Referring back to FIG. 4, while the use of the IVT 420 is provided as an example, the coldstart indication module 404 may determine whether fueling of the engine 12 should be controlled for a coldstart based on one or more other parameters. For example, the coldstart indication module 404 may determine whether fueling of the engine 12 should be controlled for a coldstart based on the engine off period, an ambient air temperature at engine startup, and a coolant temperature at engine startup. The coldstart indication module 404 may determine that fueling of the engine 12 should be controlled for a coldstart, for example, when the engine off period is greater than a predetermined period and the engine coolant temperature is within a predetermined temperature from the ambient air temperature at engine startup.

The coldstart indication module 404 indicates whether fueling of the engine 12 should be controlled for a coldstart via a coldstart signal 428. For example, the coldstart indication module 404 may set the coldstart signal 428 to a first state when fueling of the engine 12 should be controlled for a coldstart and set the coldstart signal 428 to a second state when fueling of the engine 12 should not be controlled for a coldstart. The coldstart indication module 404 may transition the coldstart signal 428 from the first state to the second state, for example, a predetermined period (e.g., approximately 30 seconds) after startup of the engine 12 and/or when closed-loop control of fueling based on feedback from the EGO sensors 38 and/or 40 begins. A mode signal 432 may indicate whether closed-loop control of fueling is being performed.

When the coldstart signal 428 is in the second state, indicating that fueling of the engine 12 should not be controlled for a coldstart, the fueling correction module 412 sets the coldstart corrections 350 for each cylinder to a predetermined value that will not affect the final EQR request 244. For example, where the final EQR request 244 is set to the product of the initial EQR request 346, the imbalance correction 342 for the next cylinder in the firing order, and the coldstart correction 350 for the next cylinder in the firing order, the fueling correction module 412 may set the coldstart corrections 350 for each cylinder to 1.0. In this manner, the final EQR request 244 will be set to the product of the initial EQR request 346 and the imbalance correction 342 for the next cylinder in the firing order.

When the coldstart signal 428 is in the first state, the fueling correction module 412 determines the coldstart corrections 350 for the cylinders based on IMEPs 436 of combustion cycles of the cylinders, respectively. For example, the fueling correction module 412 determines the coldstart correction 350 for a cylinder based on the IMEP 436 determined for that cylinder and an average IMEP 440.

The averaging module 408 determines the average IMEP 440 by averaging a predetermined number of the most recently determined IMEPs 436 for combustion cycles of cylinders, respectively. The predetermined number is an integer greater than two and may be, for example, equal to N multiplied by the total number of cylinders of the engine 12, where N is an integer greater than zero.

The fueling correction module 412 determines the coldstart correction 350 for a cylinder based on a difference between the IMEP 436 determined for that cylinder and the average IMEP 440. For example, the fueling correction module 412 may determine the coldstart corrections 350 using one of a function and mapping that relates differences between IMEP and average IMEP to coldstart corrections.

When the IMEP 436 determined for a cylinder is greater than the average IMEP 440 or within a predetermined amount or percentage less than the average IMEP 440, the fueling correction module 412 may set the coldstart correction 350 for that cylinder to the predetermined value that will not affect the final EQR request 244. As discussed above, the predetermined value may be 1.0 in the case of multiplication of the initial EQR request 346 with the coldstart correction 350 for the next cylinder in the firing order.

When the IMEP 436 determined for a cylinder is more than the predetermined amount or percentage less than the average IMEP 440, the fueling correction module 412 sets the coldstart correction 350 for that cylinder to increase fueling to that cylinder. In the example of multiplication of the initial EQR request 346 with the coldstart correction 350 for the next cylinder in the firing order, the fueling correction module 412 sets the coldstart correction 350 of a cylinder to greater than 1.0 to increase fueling to that cylinder. Increasing fueling of the cylinder increases the output of the cylinder to balance the cylinder's output with the outputs of other cylinders.

The fueling correction module 412 limits increases in the coldstart corrections 350 to a maximum increase value 442. When the increase in the coldstart correction 350 determined for a cylinder is greater than the maximum increase value 442, the fueling correction module 412 limits the increase in that coldstart correction 350 to the maximum increase value 442. In other words, the fueling correction module 412 sets that coldstart correction 350 equal to the previous value of that coldstart correction plus the maximum increase value 442.

A maximum module 444 determines the maximum increase value 442 based on the IVT 420. For example only, the maximum module 444 may determine the maximum increase value 442 using one of a function and a mapping that relates IVTs to maximum increase values. The maximum module 444 may increase the maximum increase value 442 as the IVT 420 decreases and vice versa.

After increasing the coldstart correction 350 of a cylinder, the fueling correction module 412 decreases that coldstart correction 350 by a predetermined amount per combustion cycle of that cylinder until the coldstart correction 350 reaches the predetermined value that will not affect the final EQR request 244. The fueling correction module 412 may, however, increase that coldstart correction 350 if the IMEP 436 determined for that cylinder becomes less than the average IMEP 440 by the predetermined amount or percentage.

The fueling correction module 412 selects the coldstart correction 350 for the next cylinder in the firing order and outputs that coldstart correction 350 to the final EQR module 312. The fueling correction module 412 may determine which cylinder is the next cylinder in the firing order, for example, based on the crankshaft position 324.

Figure 5:
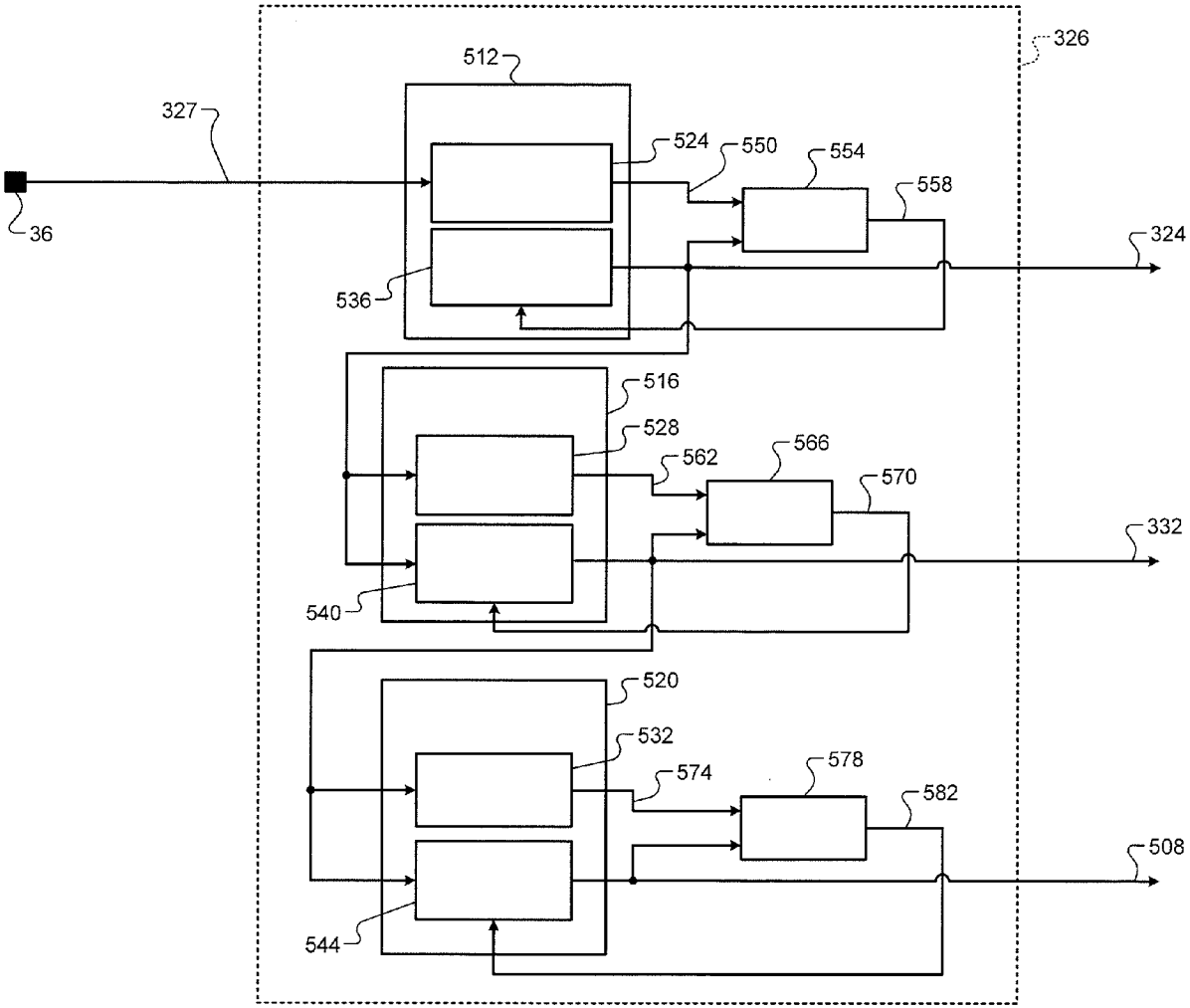
FIG. 5 is a functional block diagram of an example filter module.

FIG. 5 is a functional block diagram of an example implementation of the filter module 326. The filter module 326 generates the crankshaft position 324 and the engine speed 332 based on the crankshaft position signal 327 from the crankshaft position sensor 36. The filter module 326 may also generate a crankshaft acceleration 508 based on the crankshaft position signal 327.

The filter module 326 may include, for example, a Kalman filter, a Butterworth type II filter, a Chebyshev filter, or another suitable type of filter. In the case of the filter module 326 including a Kalman filter, the filter module 326 may include state estimators that are used to determine or estimate crankshaft position, engine speed, and crankshaft acceleration. Functions describing the dynamics of the engine 12 are defined. The functions are used to produce estimates of state variables (e.g., the crankshaft position 324, the engine speed 332, and the crankshaft acceleration 508). The estimates are compared to measured values of the state variables to generate error signals, respectively, which are fed back to correct future estimates of the state variables. For example, the error between estimated and measured engine speed is fed back to correct future estimates of the engine speed 332.

The filter module 326 may include a position filtering module 512, a speed filtering module 516, and an acceleration filtering module 520. The position, speed, and acceleration filtering modules 512, 516, and 520 include position, speed, and acceleration calculator modules 524, 528, and 532, respectively. The position, speed, and acceleration filtering modules 512, 516, and 520 also include position, speed, and acceleration estimator modules 536, 540, and 544, respectively. The outputs of the estimator modules 536, 540, and 544 are the crankshaft position 324, the engine speed 332, and the crankshaft acceleration 508, respectively.

The position calculator module 524 receives the crankshaft position signal 327 from the crankshaft position sensor 36. The position calculator module 524 generates a second crankshaft position 550 based on the crankshaft position signal 327. The position estimator module 536 outputs the crankshaft position 324.

An error module 554 generates a position error 558 based on a difference between the crankshaft position 324 and the second crankshaft position 550. The position error 558 is fed back to the position estimator module 536, and the position estimator module 536 selectively adjusts the crankshaft position 324 based on the position error 558.

The speed calculator module 528 receives the crankshaft position 324. The speed calculator module 528 generates a second engine speed 562 based on the crankshaft position 324. The speed estimator module 540 outputs the engine speed 332.

An error module 566 generates a speed error 570 based on a difference between the engine speed 332 and the second engine speed 562. The speed error 570 is fed back to the speed estimator module 540, and the speed estimator module 540 selectively adjusts the engine speed 332 based on the speed error 570.

The acceleration calculator module 532 receives the engine speed 332. The acceleration calculator module 532 generates a second acceleration 574 based on the engine speed 332. The acceleration estimator module 544 outputs the crankshaft acceleration 508.

An error module 578 generates an acceleration error 582 based on a difference between the crankshaft acceleration 508 and the second acceleration 574. The acceleration error 582 is fed back to the acceleration estimator module 544, and the acceleration estimator module 544 selectively adjusts the crankshaft acceleration 508 based on the acceleration error 582.

Figure 6:
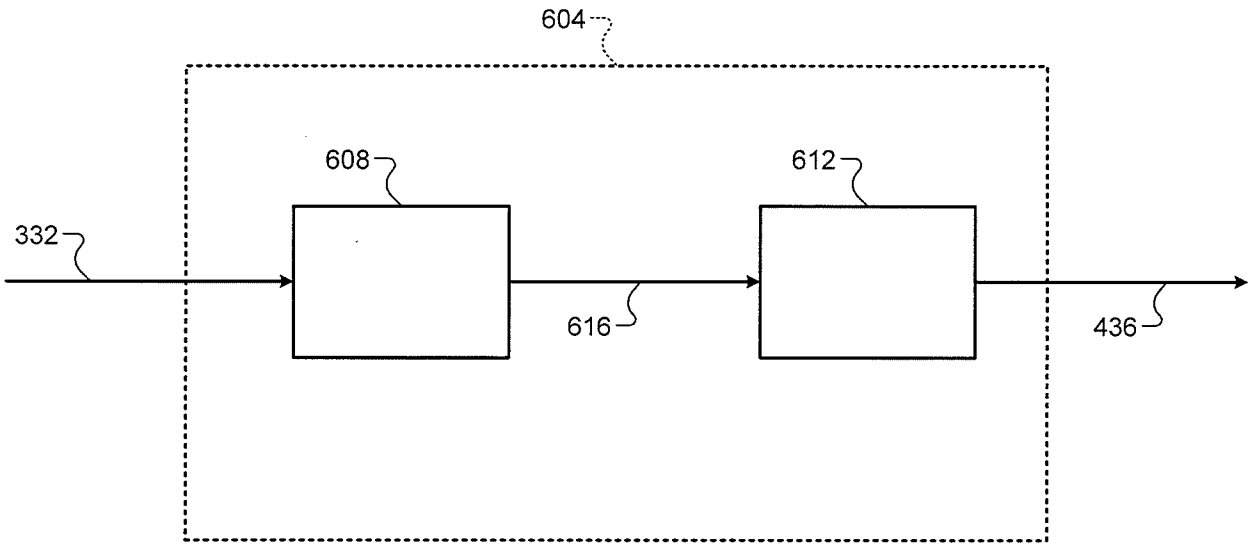
FIG. 6 is a functional block diagram of an example indicated mean effective pressure (IMEP) module.

Referring back to FIG. 2, an IMEP module 604 determines the IMEPs for the combustion cycles of the cylinders, respectively. FIG. 6 includes a functional block diagram of an example implementation of the IMEP module 604. The IMEP module 604 determines an indicated work for a combustion cycle of a cylinder based on squares of two or more values of the engine speed 332 at predetermined crankshaft positions of the combustion cycle, respectively. The IMEP module 604 determines an indicated work for each combustion cycle of each cylinder.

The IMEP module 604 determines the IMEP 436 for a combustion cycle of a cylinder based on the indicated work for the combustion cycle. The IMEP module 604 determines the IMEP 436 for the combustion cycle of the cylinder 25 further based on the displacement volume of the engine 12. The IMEP module 604 determines an IMEP for each combustion cycle of each cylinder.

The IMEP module 604 may include an indicated work determination module 608 and an IMEP determination module 612. The indicated work determination module 608 determines an indicated work 616 for a combustion cycle of a cylinder based on (mathematical) squares of two or more of the engine speeds 332 at predetermined crankshaft positions, respectively, of the combustion cycle of the cylinder.

As a first example, the indicated work determination module 608 may determine the indicated work 616 for a combustion cycle of a cylinder using the equation:

$$W=\omega_e^2-\omega_s^2, \tag{3}$$

where W is the indicated work 616, $\omega_e$ is a first engine speed 332 at a first predetermined crankshaft position of the expansion stroke of the combustion cycle of the cylinder, and $\omega_s$ is a second engine speed 332 at a second predetermined crankshaft position of the expansion stroke. The first predetermined crankshaft position is later in the expansion stroke (i.e., further from TDC) than the second predetermined crankshaft position. For example only, the first and second predetermined crankshaft positions may be approximately 36 crankshaft angle degrees (CAD) after TDC and 30 CAD after TDC, respectively, 40 CAD after TDC and 20 CAD after TDC, respectively, or other suitable crankshaft positions. In various implementations, the first predetermined crankshaft position is during the compression stroke, and the second predetermined crankshaft position is after first predetermined crankshaft position during the expansion stroke.

As a second example, the indicated work determination module 608 may determine the indicated work 616 for a combustion cycle of a cylinder using the equation:

$$W=p*(\omega_e^2-\omega_s^2)+q, \tag{4}$$

where W is the indicated work 616, $\omega_e$ is a first engine speed 332 at a first predetermined crankshaft position of the expansion stroke of the combustion cycle of the cylinder, $\omega_s$ is a second engine speed 332 at a second predetermined crankshaft position of the expansion stroke, p is a predetermined (e.g., calibrated) gain, and q is a predetermined (e.g., calibrated) offset. The first predetermined crankshaft position is later in the expansion stroke than the second predetermined crankshaft position. In various implementations, the first predetermined crankshaft position is during the compression stroke, and the second predetermined crankshaft position is after first predetermined crankshaft position during the expansion stroke.

Equation (4) can be written in matrix form as:

$$W = [\,(\omega_e^2-\omega_s^2)\quad 1\,]*\begin{bmatrix} p \\ q \end{bmatrix}. \tag{5}$$

For a large data set over Z combustion cycles, equation (5) can be expanded to:

$$\begin{bmatrix} W_1 \\ W_2 \\ \vdots \\ W_Z \end{bmatrix} = \begin{bmatrix} (\omega_{1e}^2-\omega_{1s}^2) & 1 \\ (\omega_{2e}^2-\omega_{2s}^2) & 1 \\ \vdots & \\ (\omega_{Ze}^2-\omega_{Zs}^2) & 1 \end{bmatrix} * \begin{bmatrix} p \\ q \end{bmatrix}. \tag{6}$$

The predetermined gain (p) and the predetermined offset (q) used by the indicated work determination module 608 in determining the indicated work 616 can be determined by collecting measured cylinder pressure data (using a cylinder pressure sensor not shown in FIG. 1), collecting the engine speeds 332 ($\omega_1$, $\omega_2$, . . . ) at various crankshaft positions (at least crankshaft positions e and s), determining the indicated works ($W_1$, $W_2$, . . . ) based on the measured cylinder pressure data, and solving equation (6) for the predetermined gain and the predetermined offset. For example only, the predetermined gain and the predetermined offset may be determined by solving equation (6) using a regression fit analysis. Once the predetermined gain and the predetermined offset have been determined, the indicated work determination module 608 can determine the indicated work 616 during operation of the engine 12 without measured cylinder pressure data and without a cylinder pressure sensor.

As a third example, the indicated work determination module 608 may determine the indicated work 616 for a combustion cycle of a cylinder using the equation:

$$W=(\omega_e^2-\omega_s^2)+(\omega_y^2-\omega_x^2), \quad (7)$$

where W is the indicated work 616, $\omega_e$ is a first engine speed 332 at a first predetermined crankshaft position of the expansion stroke of the combustion cycle of the cylinder, $\omega_s$ is a second engine speed 332 at a second predetermined crankshaft position of the expansion stroke, $\omega_y$ is a third engine speed 332 at a third predetermined crankshaft position of the compression stroke of the combustion cycle of the cylinder 25, and $\omega_x$ is a fourth engine speed 332 at a fourth predetermined crankshaft position of the compression stroke. The first predetermined crankshaft position is later in the expansion stroke than the second predetermined crankshaft position, and the fourth predetermined crankshaft position is later in the compression stroke (i.e., more toward TDC) than the third predetermined crankshaft position. For example only, the first, second, third, and fourth predetermined crankshaft positions may be approximately 36 CAD after TDC, 30 CAD after TDC, 60 CAD before TDC, and 24 CAD before TDC, respectively.

As a fourth example, the indicated work determination module 608 may determine the indicated work 616 for a combustion cycle of a cylinder using the equation:

$$W=p*(\omega_e^2-\omega_s^2)+q(\omega_y^2-\omega_x^2)+r, \quad (8)$$

where W is the indicated work 616, $\omega_e$ is a first engine speed 332 at a first predetermined crankshaft position of the expansion stroke of the combustion cycle of the cylinder, $\omega_s$ is a second engine speed 332 at a second predetermined crankshaft position of the expansion stroke, $\omega_y$ is a third engine speed 332 at a third predetermined crankshaft position of the compression stroke of the combustion cycle of the cylinder 25, $\omega_x$ is a fourth engine speed 332 at a fourth predetermined crankshaft position of the compression stroke, p and q are first and second predetermined gains, respectively, and r is a predetermined offset. The first predetermined crankshaft position is later in the expansion stroke than the second predetermined crankshaft position, and the fourth predetermined crankshaft position is later in the compression stroke than the third predetermined crankshaft position. The first and second predetermined gains (p and q) and the predetermined offset (r) may be determined similar to that described above.

As a fifth example, the indicated work determination module 608 may determine the indicated work 616 for a combustion cycle of a cylinder using the equation:

$$W=p*\omega_p^2+q*\omega_q^2+r*\omega_r^2+s*\omega_s^2+t*\omega_t^2+u*\omega_u^2+v, \quad (9)$$

where W is the indicated work 616, $\omega_p$, $\omega_q$, $\omega_r$, $\omega_s$, $\omega_t$, and $\omega_u$ are first, second, third, fourth, fifth, and sixth engine speeds 332 at first, second, third, fourth, fifth, and sixth predetermined crankshaft positions of the combustion cycle of the cylinder, respectively, p, q, r, s, t, and u are first, second, third, fourth, fifth, and sixth predetermined gains, and v is a predetermined offset. For example only, the first, second, third, fourth, fifth, and sixth predetermined crankshaft positions may be approximately 72 CAD before TDC, 36 CAD before TDC, 24 CAD before TDC, 12 CAD after TDC, 30 CAD after TDC, and 36 CAD after TDC, respectively. The first, second, third, fourth, fifth and sixth predetermined gains (p, q, r, s, t, and u) and the predetermined offset (v) may be determined in a similar manner to that described above in conjunction with equations (2)-(4). In various implementations, the indicated work determination module 608 may determine the indicated work 616 using another suitable function or mapping that relates two or more squares of engine speed 332 to the indicated work 616.

The IMEP determination module 612 determines the IMEP 436 for the combustion cycle of a cylinder based on the indicated work 616 for the combustion cycle of that cylinder. The IMEP determination module 612 may determine the IMEP 436 further based on a displacement volume of the engine 12. For example only, the IMEP determination module 612 may set the IMEP 436 equal to the indicated work 616 for the combustion cycle divided by the displacement volume of the engine 12. As the IMEP 436 is determined from the indicated work 616 determined specifically for the combustion event of the cylinder, the IMEP 436 can be referred to as an absolute IMEP and not as a relative IMEP that is determined relative to other cylinders of the engine 12. While the example of determining the IMEPs 436 based on the engine speeds 332 is shown and discussed, the IMEPs 436 may be determined in another way, such as based on one or more cylinder pressures measured using cylinder pressure sensors or based on one or more torques measured using a torque sensor.

Figure 7:
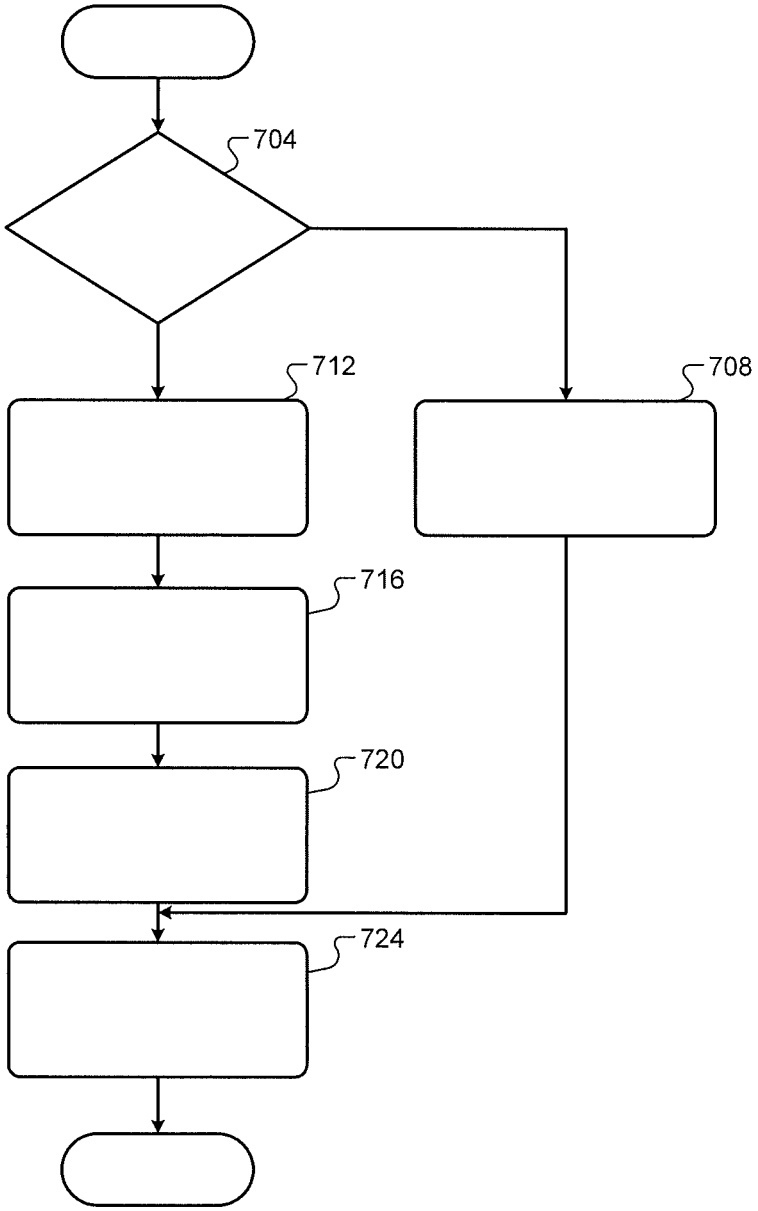
FIG. 7 is a flowchart depicting an example method of controlling fueling for an engine startup.

Referring now to FIG. 7, a flowchart including an example method of controlling fueling for a startup of the engine 12 is presented. Control begins at 704 when the engine 12 is started. At 704, the coldstart indication module 404 determines and indicates whether the engine 12 is in a cold state. In other words, the coldstart indication module 404 determines and indicates whether the engine startup is a cold start at 704. If 704 is false, control continues with 708. If 704 is true, control continues with 712. The coldstart indication module 404 may indicate that the engine 12 is in the cold state, for example, when the IVT 420 is less than the predetermined temperature. The initial EQR module 310 also generates the initial EQR request 346 for the next cylinder in the firing order at 704.

At 708, when the engine 12 is not in the cold state, the fueling correction module 412 sets the coldstart corrections 350 for the cylinders to the predetermined value that will not affect the final EQR request 244. For example, the fueling correction module 412 may set the coldstart corrections 350 for the cylinders, respectively, to 1.0 in the example where the coldstart corrections 350 are multiplied with the initial EQR request 346 to generate the final EQR request 244. Control continues with 724, which is discussed further below.

At 712, when the engine 12 is in the cold state, the fueling correction module 412 determines the coldstart correction 350 for the next cylinder in the firing order of the cylinders. The fueling correction module 412 determines the coldstart correction 350 for the next cylinder based on a difference between the IMEP 436 determined for that cylinder and the average IMEP 440.

The fueling correction module 412 may set the coldstart correction 350 to the predetermined value when the IMEP 436 determined for the cylinder is greater than the average IMEP 440. When the IMEP 436 determined for the cylinder is less than the average IMEP 440, the fueling correction module 412 may set the coldstart correction 350 to greater than the predetermined value. When the coldstart correction 350 for the next cylinder was previously greater than the predetermined value and would now be set to the predetermined value, the fueling correction module 412 may decrease the coldstart correction 350 for the next cylinder toward the predetermined value by up to the predetermined amount.

The IMEP 436 determined for a cylinder may be less than the average IMEP 440 due to less fuel vaporization within the cylinder. Setting the coldstart correction 350 for a cylinder to greater than the predetermined value increases fueling of the cylinder and, therefore, increases the output of the cylinder.

At 716, the maximum module 444 determines the maximum increase value 442. The maximum module 444 determines the maximum increase value 442 based on the IVT 420. For example, the maximum module 444 may increase the maximum increase value 442 as the IVT 420 decreases and vice versa.

The fueling correction module 412 limits an increase in the coldstart correction 350 for the next cylinder to the maximum increase value 442 at 720. More specifically, when the coldstart correction 350 for the next cylinder is to increase relative to its previous value from a last combustion cycle of that cylinder, the fueling correction module 412 may limit the increase in the coldstart correction 350 to the maximum increase value 442. Control continues with 724.

At 724, the final EQR module 312 generates the final EQR request 244 for the next cylinder in the firing order based on the coldstart correction 350 for the next cylinder. For example, the final EQR module 312 may set the final EQR request 244 based on a product of the initial EQR request 346 and the coldstart correction 350 for the next cylinder. The final EQR module 312 controls fueling of the next cylinder in the firing order at 724 based on the final EQR request 244. While the example of FIG. 7 is shown as ending after 724, FIG. 7 is illustrative of one control loop, and a control loop may be performed for each combustion cycle of each cylinder.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term 'module' or the term 'controller' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium include nonvolatile memory circuits (such as a flash memory circuit or a mask read-only memory circuit), volatile memory circuits (such as a static random access memory circuit and a dynamic random access memory circuit), and secondary storage, such as magnetic storage (such as magnetic tape or hard disk drive) and optical storage.

The apparatuses and methods described in this application may be partially or fully implemented by a special purpose computer created by configuring a general purpose computer to execute one or more particular functions embodied in computer programs. The computer programs include processor-executable instructions that are stored on at least one non-transitory, tangible computer-readable medium. The computer programs may also include or rely on stored data. The computer programs may include a basic input/output system (BIOS) that interacts with hardware of the special purpose computer, device drivers that interact with particular devices of the special purpose computer, one or more operating systems, user applications, background services and applications, etc.

The computer programs may include: (i) assembly code; (ii) object code generated from source code by a compiler; (iii) source code for execution by an interpreter; (iv) source code for compilation and execution by a just-in-time compiler, (v) descriptive text for parsing, such as HTML (hypertext markup language) or XML (extensible markup language), etc. As examples only, source code may be written in C, C++, C#, Objective-C, Haskell, Go, SQL, Lisp, Java®, Smalltalk, ASP, Perl, Javascript®, HTML5, Ada, ASP (active server pages), Perl, Scala, Erlang, Ruby, Flash®, Visual Basic®, Lua, or Python®.

None of the elements recited in the claims is intended to be a means-plus-function element within the meaning of 35 U.S.C. §112(f) unless an element is expressly recited using the phrase "means for", or in the case of a method claim using the phrases "operation for" or "step for".

What is claimed is:

1. A fuel control system for a vehicle, comprising:

an indicated mean effective pressure (IMEP) module that determines IMEPs for combustion cycles of cylinders of an engine, respectively;

a coldstart indication module that indicates whether the engine is in a cold state after a startup of the engine;

a fueling correction module that, when the engine is in the cold state, selectively increases a fueling correction for one of the cylinders based on the IMEP of the one of the cylinders; and an equivalence ratio (EQR) module that selectively increases an EQR of the one of the cylinders based on the fueling correction for the one of the cylinders.

2. The fuel control system of claim 1 further comprising an averaging module that averages the IMEPs for combustion cycles of at least two of the cylinders, respectively, to produce an average IMEP, wherein the fueling correction module selectively increases the fueling correction for the one of the cylinders based on a difference between the IMEP of the one of the cylinders and the average IMEP.

3. The fuel control system of claim 2 wherein the fueling correction module increases the fueling correction for the one of the cylinders when the IMEP of the one of the cylinders is less than the average IMEP.

4. The fuel control system of claim 2 wherein, when the IMEP of the one of the cylinders is within a predetermined amount of the average IMEP:

the fueling correction module sets the fueling correction for the one of the cylinders to a predetermined value; and the EQR module does not increase the EQR of the one of the cylinders when the fueling correction is set to the predetermined value.

5. The fuel control system of claim 1 wherein the fueling correction module limits the increase in the fueling correction for the one of the cylinders to a maximum increase value.

6. The fuel control system of claim 5 further comprising a maximum module that determines the maximum increase value based on an intake valve temperature.

7. The fuel control system of claim 6 wherein the maximum module:

increases the maximum increase value as the intake valve temperature decreases; and decreases the maximum increase value as the intake valve temperature increases.

8. The fuel control system of claim 6 wherein the coldstart indication module indicates that the engine is in the cold state after the startup of the engine when the intake valve temperature is less than a predetermined temperature.

9. The fuel control system of claim 1 wherein, when the engine is not in the cold state after the engine startup:

the fueling correction module sets the fueling correction for the one of the cylinders to a predetermined value; and the EQR module does not increase the EQR of the one of the cylinders when the fueling correction is set to the predetermined value.

10. The fuel control system of claim 1 wherein, after increasing the fueling correction of the one of the cylinders based on the IMEP of the one of the cylinders, the fueling correction module selectively decreases the fueling correction of the one of the cylinders at a predetermined rate.

11. A fuel control method for a vehicle, comprising:

determining indicated mean effective pressures (IMEPs) for combustion cycles of cylinders of an engine, respectively;

indicating whether the engine is in a cold state after a startup of the engine;

when the engine is in the cold state, selectively increasing a fueling correction for one of the cylinders based on the IMEP of the one of the cylinders; and selectively increasing an equivalence ratio (EQR) of the one of the cylinders based on the fueling correction for the one of the cylinders.

12. The fuel control method of claim 11 further comprising:

averaging the IMEPs for combustion cycles of at least two of the cylinders, respectively, to produce an average IMEP; and selectively increasing the fueling correction for the one of the cylinders based on a difference between the IMEP of the one of the cylinders and the average IMEP.

13. The fuel control method of claim 12 further comprising increasing the fueling correction for the one of the cylinders when the IMEP of the one of the cylinders is less than the average IMEP.

14. The fuel control method of claim 12 further comprising, when the IMEP of the one of the cylinders is within a predetermined amount of the average IMEP:

setting the fueling correction for the one of the cylinders to a predetermined value; and not increasing the EQR of the one of the cylinders when the fueling correction is set to the predetermined value.

15. The fuel control method of claim 11 further comprising limiting the increase in the fueling correction for the one of the cylinders to a maximum increase value.

16. The fuel control method of claim 15 further comprising determining the maximum increase value based on an intake valve temperature.

17. The fuel control method of claim 16 further comprising:

increasing the maximum increase value as the intake valve temperature decreases; and decreasing the maximum increase value as the intake valve temperature increases.

18. The fuel control method of claim 16 further comprising indicating that the engine is in the cold state after the startup of the engine when the intake valve temperature is less than a predetermined temperature.

19. The fuel control method of claim 11 further comprising, when the engine is not in the cold state after the engine startup:

setting the fueling correction for the one of the cylinders to a predetermined value; and not increasing the EQR of the one of the cylinders when the fueling correction is set to the predetermined value.

20. The fuel control method of claim 11 further comprising, after increasing the fueling correction of the one of the cylinders based on the IMEP of the one of the cylinders, selectively decreasing the fueling correction of the one of the cylinders at a predetermined rate.

* * * * *